United States Patent [19]

Hildebrand et al.

[11] 4,060,169

[45] Nov. 29, 1977

[54] FOLDABLE CONTAINER

[75] Inventors: Larry R. Hildebrand, Center Valley; Siegfried K. Pausinger, Allentown, both of Pa.

[73] Assignee: Packaging Corporation of America, Evanston, Ill.

[21] Appl. No.: 696,534

[22] Filed: June 16, 1976

[51] Int. Cl.[2] ..... B65D 85/18; B65D 5/22

[52] U.S. Cl. ..... 206/289; 206/300; 229/34 HW

[58] Field of Search ..... 206/284–291, 206/300; 229/34 HW

[56] References Cited

U.S. PATENT DOCUMENTS

| | | | |
|---|---|---|---|
| 1,617,365 | 2/1927 | Batts | 206/291 |
| 1,626,381 | 4/1927 | Batts | 206/291 |
| 1,954,607 | 4/1934 | Wheary et al. | 206/289 |
| 1,958,230 | 5/1934 | Blechman | 206/289 |
| 3,057,460 | 10/1962 | Richer | 206/289 |
| 3,115,968 | 12/1963 | Peterson | 206/300 |
| 3,259,229 | 7/1966 | Brittingham | 206/289 |

*Primary Examiner*—William Price
*Assistant Examiner*—Douglas B. Farrow
*Attorney, Agent, or Firm*—Neuman, Williams, Anderson & Olson

[57] ABSTRACT

A foldable container is provided for accommodating a product having a hanger loop associated therewith. The container includes end panels, side panels and a bottom section which cooperate with one another to define an open top compartment in which the product is placed. At least one end panel is provided with an interior wall panel foldably connected thereto and having a slotted section which is disposed inwardly of the end panel and assumes a spaced face to face relation therewith. The slot is adapted to accommodate the product hanger loop. A top section is adapted to overlie and close the compartment open top subsequent to the product being placed within the compartment.

12 Claims, 5 Drawing Figures

FOLDABLE CONTAINER

BACKGROUND OF THE INVENTION

In recent years it has become increasingly popular for various garments such as jackets, shirts, blouses, etc. to be shipped to the customer by the retailer, or to the retailer from the wholesaler or manufacturer with the garment already placed on a conventional garment hanger which has a hanger loop formed thereon and protruding from the neck of the garment. With such a product it is important that the hanger be anchored in place once the product is positioned within the container otherwise the hanger might tear or otherwise damage the garment while the loaded container is being subjected to normal handling.

Heretofore, the anchoring of the hanger loop required the same to be taped or tied to either the end wall or bottom of the container which was an awkward, time-consuming operation both for the sender and receiver of the container. Furthermore, in such arrangements, the distal end of the hanger loop was frequently exposed, thus causing the accommodated garment to become snagged thereby, particularly if several garments were accommodated in a single container.

In other prior containers of this general type, numerous components and/or inserts were required which complicated setup of the container as well materially increased the initial cost thereof. Furthermore, such containers could not be readily formed by utilizing conventional automatic high speed, slotting, cutting and scoring equipment. Oftentimes, these prior containers could not be shipped to or stored by the users in a completely unfolded or collapsed state.

SUMMARY OF THE INVENTION

Thus, it is an object of the invention to provide a foldable container of the type described which is not beset with the aforenoted shortcomings associated with prior containers.

It is a further object of the invention to provide a foldable container of the type described which is capable of accommodating at one time either a single hangered product or a plurality of such products.

It is a still further object of the invention to provide a foldable container which is formed from a single blank of sheet material, can be readily set up either manually or by automatic or semi-automatic equipment, and is of sturdy yet inexpensive construction.

Further and additional objects will appear from the description, accompanying drawings and appended claims.

In accordance with one embodiment of the invention a foldable container is provided which is adapted to accommodate one or more products having a hanger loop associated therewith. The container includes a pair of side panels and a pair of end panels which cooperate with a bottom section to form an open top compartment in which the product is positioned. At least one of the end panels includes an interior wall panel having a slotted first section which is disposed inwardly of the end panel and in spaced face to face relation therewith. The upper edges of the end panel and the first section are foldably connected to one another by a second section. The upper end of the slot formed in the first section terminates within the second section and thus, facilitates positioning the hanger loop of a product within the slot of the first section. Once the desired number of products are positioned within the compartment, the open top thereof is closed by a top section.

DESCRIPTION

For a more complete understanding of the invention reference should be made to the drawings wherein.

Figure 5:
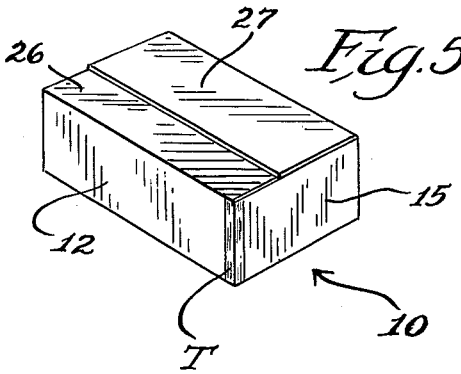
FIG. 5 is similar to FIG. 3 but on a reduced scale and showing the improved container closed and ready for shipment or storage.
Figure 3:
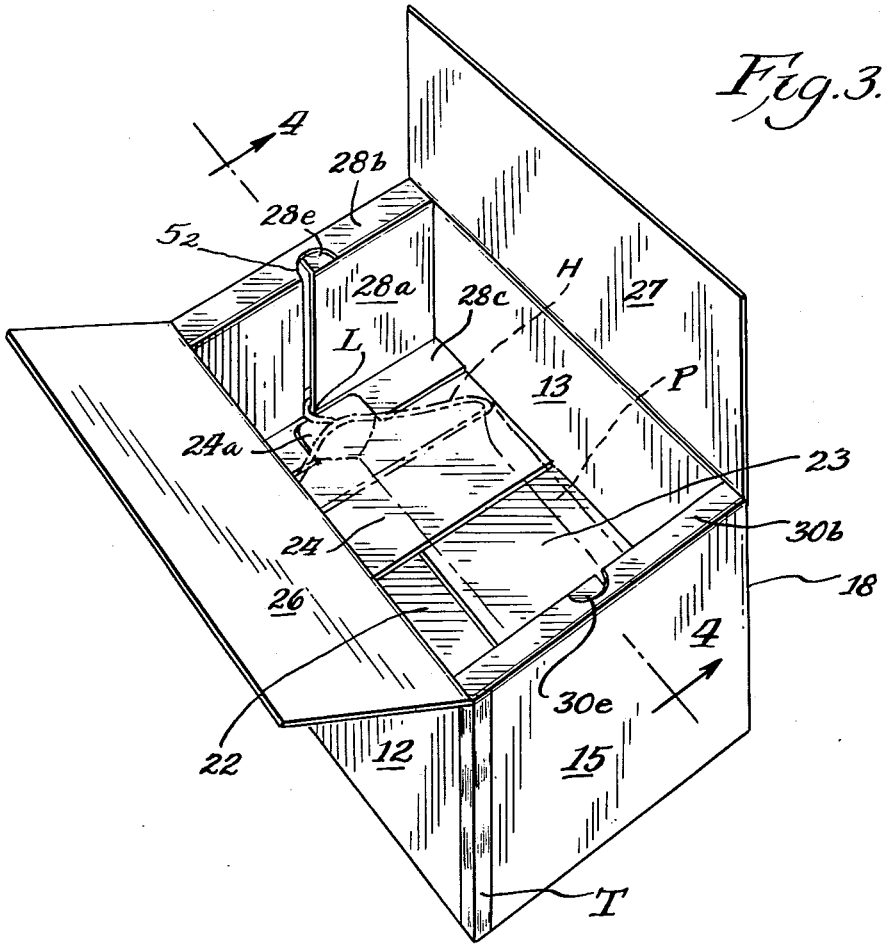
FIG. 3 is a perspective top view of the improved container formed from the blank of FIG. 1 and shown setup for loading; a hangered garment is shown in phantom lines accommodated within the container compartment.
Figure 4:
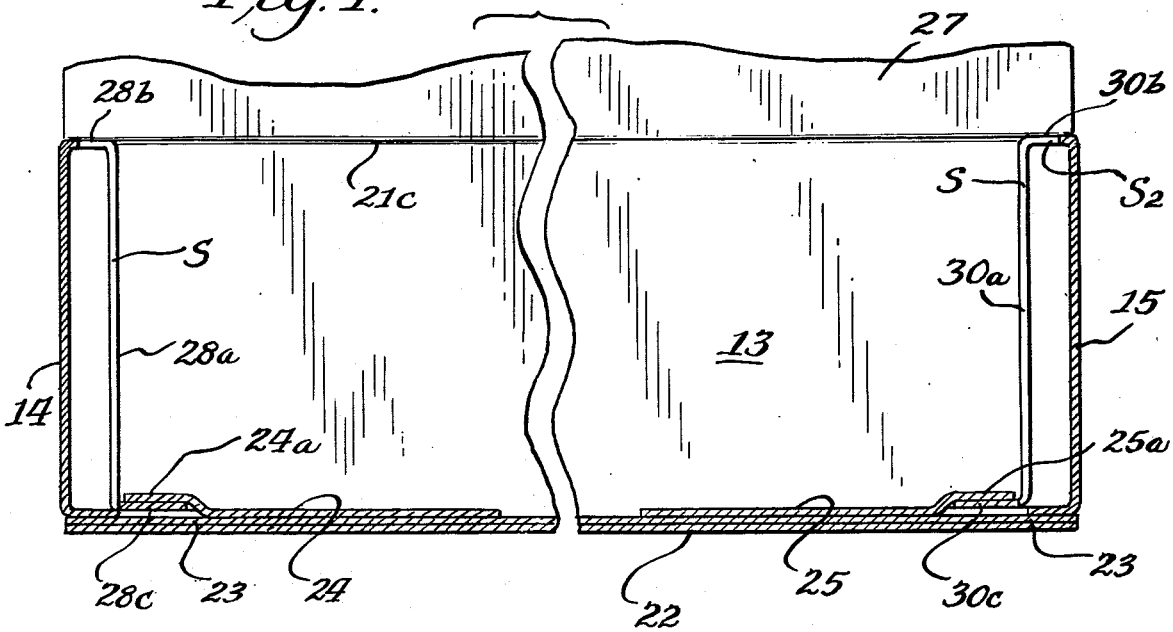
FIG. 4 is an enlarged, fragmentary, sectional view taken along line 4—4 of FIG. 3.

Referring now to the drawings and more particularly to FIG. 5, one form of the improved container 10 is shown which is adapted to readily accommodate one or more products, each having a hanger loop L associated therewith. The product P might be wearing apparel such as a shirt, blouse, sweater, etc. which is positioned on a conventional coat hanger H prior to being loaded into the container, as seen in FIG. 3. The hanger H has the loop L thereof protruding through the neck of the garment. When more than one garment is to be packaged in the container 10, the garments are arranged in stacked relation with successive garments being turned 180° relative to one another so that one side of the stack will not be of greater height than the opposite side. Where, however, only one garment or only a few garments are to be accommodated within the container, inverting successive garments might not be necessary.

Figure 1:
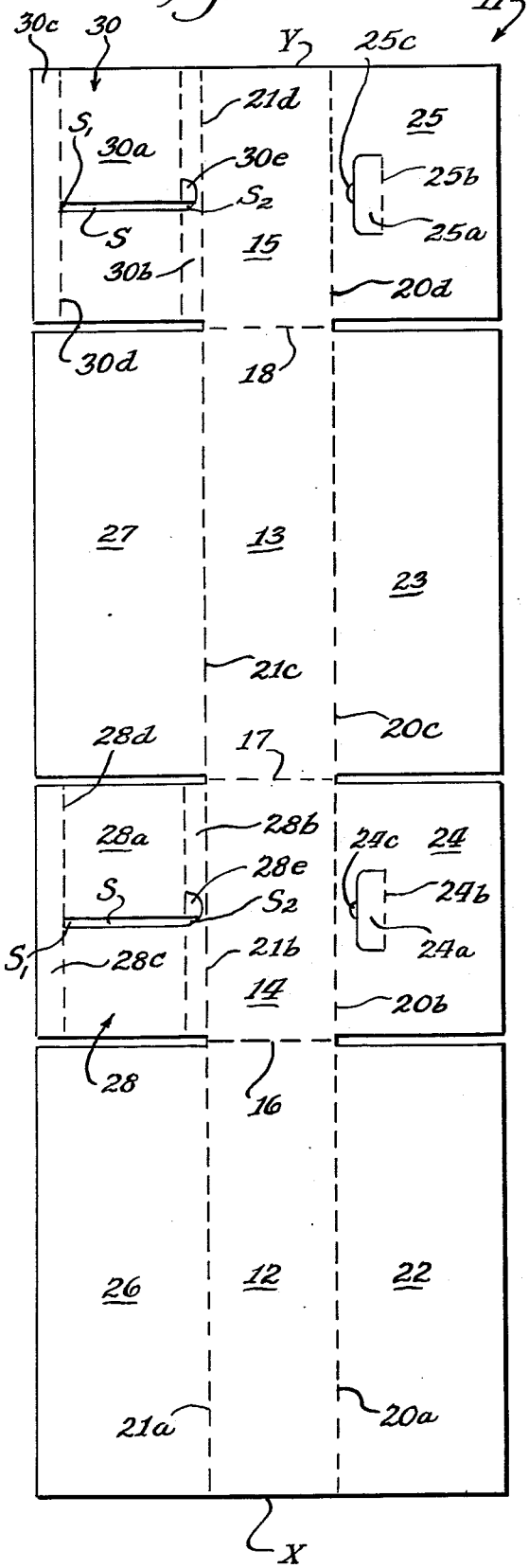
FIG. 1 is a top plan view of one form of a blank used in forming the improved container.

Container 10 is formed from a single blank 11 of foldable sheet material (e.g., double-faced corrugated fibreboard). The blank 11, as seen in FIG. 1, includes a pair of elongated side panels 12 and 13, and a pair of end panels 14 and 15 which are arranged in aligned, but alternate, relation with the panels 12 and 13. End panel 14 is disposed between panels 12 and 13 and is foldably connected to the adjacent ends thereof by parallel foldlines 16 and 17, respectively. End panel 15 is connected by foldline 18 to the opposite end of panel 13.

The corresponding bottom edges of panels 12–15 are defined by a sectional foldline **20*a*, 20*b*, 20*c* and 20*d*. In a similar manner the corresponding upper edges of the panels are defined by a sectional foldline 21*a*, 21*b*, 21*c* and 21*d*. The sectional foldlines are disposed in substantially parallel relation and are substantially transverse to the foldlines 16-18**.

Foldlines **20*a* and 20*c* connect similar bottom panels 22 and 23 to side panels 12 and 13, respectively. In a similar manner, foldlines 20*b* and 20*d* connect similar bottom closure flaps 24 and 25 to end panels 14 and 15**, respectively.

Foldlines **21*a* and 21*c* connect top panels 26 and 27 to corresponding panels 12 and 13 and in a similar manner foldlines 21*b* and 21*d* connect interior wall panels 28 and 30 to end panels 14 and 15, respectively. In the illustrated embodiment, the interior wall panels are of like construction and each panel includes a slotted first section 28*a*, 30*a*, and a second section 28*b*, 30*b* which foldably connects the first section to the upper edge of the adjacent end panel 14, 15. To the opposite edge of first section 28***a*, 30*a* is foldably connected a flaplike third section 28*c*, 30*c*.

It will be noted in FIG. 1 that the elongated slots S formed in the first section 28*a*, 30*a* extends transversely of the foldline 21*b*, 21*d* which joins the second section 28*b*, 30*b* to the adjacent end panel 14, 15. One end $S_1$ of the slot terminates at a foldline 28*d*, 30*d* which connects the first and third sections. The opposite end $S_2$ of the slot terminates within the second section near the foldline 21*b*, 21*d*. The slot S is provided so as to receive the loop L of the hanger H when the garment is accommodated within the container, in a manner to be discussed more fully hereinafter.

As seen in FIG. 1, each bottom closure flap 24, 25 is of like construction and includes a tab 24*a*, 25*a* which is struck out from the flap and is adapted to pivot about a folding score 24*b*, 25*b*. The function of the tab will become apparent from the description to follow hereinafter. A finger hole 24*c*, 25*c* is provided to facilitate moving of the tab about the score 24*b*, 25*b*.

In setting up the blank 11 to form the container 10, the bottom panels 22, 23 and bottom closure flaps 24, 25 are folded about their respective foldlines 20*a*, 20*c*, 20*b* and 20*d*, so that they overlie in face to face relation the side panels 12, 13 and end panels 14, 15. Depending upon the height of the side and end panels, the bottom panels and bottom closure flaps might also partially overlie the corresponding top panels 26, 27 and the interior wall panels 28, 30.

Figure 2:
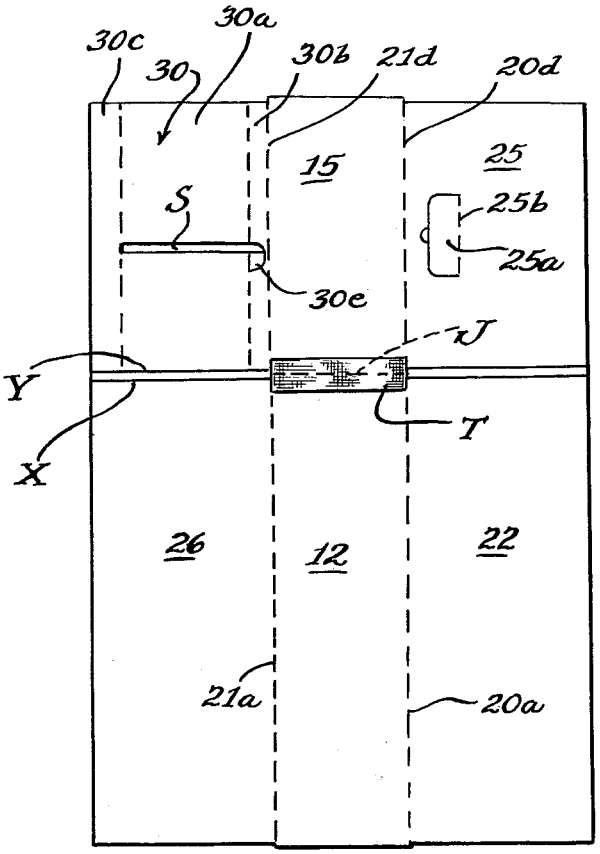
FIG. 2 is similar to FIG. 1 but showing the blank thereof in a collapsed partially setup condition.

Subsequent to the aforementioned initial folding step, side panel 12 and associated panels 22, 26 are folded as a unit about foldline 16 so as to overlie end panel 14 and partially overlie side panel 13. In a similar manner end panel 15 and associated flap 25 and interior wall panel 30 are folded as a unit about foldline 18 so as to partially overlie side panel 13. When this latter folding step has occurred the free edges X and Y of the blank will be disposed in substantially abutting relations and a tape section T applied so as to overlie the joint J formed by the blank edges X, Y, as seen in FIG. 2. In lieu of the tape section, a conventional glue flap, not shown, may be foldably connected to either free edge X, Y at either side panel 12 or end panel 15. Such glue flap may be secured in place either by adhesive or staples.

The blank 11 may be shipped to or stored by the user either in the completely unfolded state (FIG. 1) or in the collapsed partially setup state (FIG. 2).

To set up the blank for loading from the collapsed state shown in FIG. 2, requires the blank to be squared up so that the side panels 12, 13 and the end panels 14 and 15 will assume opposed, substantially parallel, spaced relation. Once the side and end panels are in such relative positions, the flaps 24 and 25 are folded about foldlines 20*b* and 20*d* so as to overlie the interior surfaces of end panels 14, 15. The bottom panels 22, 23 are then folded inwardly about foldlines 20*a*, 20*c* respectively so as to assume substantially coplanar relation. If the inner elongated edge portions of the panels 22, 23 overlap one another they are secured in such relation by adhesive, taping or stapling. If on the other hand, they merely abut one another then a section of tape will overlie the joint therebetween and be secured to the adjacent edge portions. Once panels 22, 23 are in proper folded relation the flaps 24 and 25 are folded down into overlying relation with the panels 22, 23. The interior wall panels 28, 30 are then folded inwardly towards one another about foldline sections 21*b*, 21*d*, respectively, until panel sections 28*b*, 30*b* assume substantially horizontal positions. Panel sections 28*c*, 30*c* are then folded upwardly relative to sections 28*a*, 30*a* and then sections 25*a*, 30*a* are folded downwardly relative to panel sections 28*b*, 30*b* until the sections 28*a*, 30*a* assume spaced substantially parallel relation with respect to the end panels 14, 15. In order to retain the panel sections 28*a*, 30*a* in the proper spaced relation, the panel sections 28*c*, 30*c* are positioned beneath the corresponding struckouts 24*a*, 25*a*.

It will be noted in FIGS. 1 and 3 that adjacent the end $S_2$ of each slot S, there is provided a tongue-like element 28*e*, 30*e* which is struck out from the panel section 28*b*, 30*b*. The element 28*e*, 30*e* serves to prevent accidental disengagement of the hanger loop L from the slot once the loop has been inserted into the slot.

While the improved container 10 has been described and illustrated as having an interior wall panel foldably connected to both end panels 14 and 15, the invention herein disclosed and claimed is not intended to be limited thereto. For example, in certain instances only one of the end panels need be provided with an interior wall panel where it is customary for only a single hangered garment to be packaged in a given container, or where all the hangered garmets within the container have the hanger loops thereof disposed adjacent one end panel.

Furthermore, in lieu of the interior wall panel having a foldable section 28*c*, 30*c*, the slotted section 28*a*, 30*a* could be provided with one or more projections formed along its outer edge which would snap into locking engagement with aligned apertures, not shown, formed in the bottom flap 24, 25, when the panel section 28*a*, 30*a* is in its proper relative position with respect to the adjacent end panel. The apertures in such a modified embodiment would be in substitution of the struckouts 24*a*, 25*a* shown in FIG. 1.

Also, if desired, a single bottom panel and/or a single top panel maybe utilized in place of the pairs of top and bottom panels as shown. In such a modified construction, the single panel would be of such size and configuration that it would completely cover the area delimited by the side and end panels.

Thus, it will be noted that an improved foldable container has been provided which is of simple, inexpensive construction and may be readily shipped or stored while in a collapsed state. The improved container is capable of readily accommodating and concealing the hanger loops of the garments packaged therein and thus, prevent the garments being torn or otherwise damaged by the loops during normally handling of the loaded container.

We claim:

1. A foldable container formed from a single blank of sheet material for accommodating a product having a hanger loop associated therewith, said container comprising a bottom for subtending the accommodated product; a pair of opposed side walls extending angularly from said bottom; a pair of opposed end walls extending angularly from said bottom and disposed intermediate said side walls, adjacent walls being integral with one another and separted from one another by a foldline, said walls and bottom cooperating to form an open top product-receiving compartment; and a top section foldably connected to at least one side wall for overlying and closing the compartment open top; one end wall including an outer panel and an inner panel connected thereto by a second foldline, the inner panel defining a surface portion of said compartment and being provided with an elongated hanger loop-receiving slot angularly disposed relative to said bottom and having an end portion thereof intersecting said second foldline, said inner panel being disposed in spaced, face to face relation with said outer panel and being foldably connected thereto.

2. The foldable container of claim 1 wherein the bottom includes first panels foldably connected to the bottom edges of said side walls and folded towards one another, and a second panel foldably connected to the bottom edge of said one end wall and folded relative thereto and subtending said inner panel and overlying said first panels.

3. The foldable container of claim 2 wherein the inner panel of said one end wall includes means for retaining same in spaced, face to face relation with the outer panel.

4. The foldable container of claim 1 wherein the other end wall includes an outer panel and an inner panel disposed in spaced, face to face relation therewith and being connected thereto by a third foldline; said inner panel being provided with an elongated hanger loop-receiving slot angularly disposed relative to the bottom and having an end portion thereof intersecting said third foldline, the slots in the inner panels of said end walls being in substantially parallel relation.

5. The foldable container of claim 1 wherein the top section includes a pair top closure panels foldably connected to the upper edges of said side walls and, when folded towards one another relative to said side walls, overlying and closing the compartment open top.

6. The foldable container of claim 2 wherein the bottom edge of the inner panel has foldably connected thereto a flap which is substantially subtended by the second panel connected to said one end wall; said second panel being provided with a struckout which engages and overlies a peripheral portion of said flap.

7. A blank of foldable sheet material for use in forming a container for accommodating a product having a hanger loop associated therewith, said blank comprising a pair of side wall panels; a pair of end wall panels disposed in alternate, aligned relation with the side wall panels, adjacent wall panels being separated from one another by a first foldline; at least one bottom closure panel foldably connected to a first peripheral segment of one side wall panel whereby said side wall panels, end wall panels and bottom closure panel cooperate to define an open top product-receiving compartment when said blank is set up to form a container; an inner wall panel connected by a second foldline to at least one end wall panel, said second foldline being angularly disposed relative to said first foldline, said inner wall panel including a first section provided with an elongated hanger loop-accommodating slot and being adapted to assume a spaced face to face relation with the end wall panel to which it is connected when said blank is set up to form a container, and a second section having one peripheral segment connected by a third foldline to said first section and a second peripheral segment connected to the adjacent end wall panel by said second foldline, said third foldline being intersected by one end of the elongated slot.

8. The blank of claim 7 wherein both end wall panels include inner wall panels foldably connected thereto, each inner wall panel being provided with a first section having an elongated hanger loop-accommodating slot formed therein and extending in an upright direction when said blank is set up to form a container, and a second section foldably connected to said first section and to a peripheral segment of the adjacent end wall panel.

9. The blank of claim 7 including a bottom closure flap foldably connected to the one end wall panel to which the inner wall panel is connected; said closure flap being provided with means for engaging the inner wall panel and retaining the first section thereof in spaced face to face relation with the said one end wall panel, when the blank is set up to form a container.

10. The blank of claim 9 wherein the means provided in the bottom closure flap includes a struckout engaging the portion of inner wall panel first section disposed adjacent the bottom closure panel when the blank is set up to form a container.

11. The blank of claim 8 including bottom closure flaps foldably connected to both end wall panels, each closure flap being provided with means for engaging the inner wall panel connected to the corresponding end wall panel and retaining the first section of the inner wall panel in spaced face to face relation with the adjacent end wall panel, when the blank is set up to form a container.

12. The blank of claim 11 wherein the first section of each inner wall panel includes means which lockingly engages the retaining means provided on the corresponding bottom closure flap, when the blank is set up to form a container.

* * * * *